United States Patent [19]

Hamilton et al.

[11] Patent Number: 4,551,598

[45] Date of Patent: Nov. 5, 1985

[54] ILLUMINATED MEMBRANE SWITCH

[75] Inventors: Lawrence E. Hamilton, Chicago; Renzo N. Rutili, Evanston, both of Ill.

[73] Assignee: Stewart-Warner Corporation, Chicago, Ill.

[21] Appl. No.: 610,652

[22] Filed: May 16, 1984

Related U.S. Application Data

[63] Continuation-in-part of Ser. No. 536,637, Sep. 28, 1983, Pat. No. 4,493,958.

[51] Int. Cl.[4] ..... H01H 9/18

[52] U.S. Cl. ..... 200/314; 200/310

[58] Field of Search ..... 200/310, 314, 313

[56] References Cited

U.S. PATENT DOCUMENTS

| | | | |
|---|---|---|---|
| 4,163,883 | 8/1979 | Boulanger | 200/314 |
| 4,177,501 | 12/1979 | Karlin | 200/314 X |
| 4,197,439 | 4/1980 | Mecklenberg et al. | 200/314 X |
| 4,247,797 | 1/1981 | Swatten | 200/314 |
| 4,288,672 | 9/1981 | Puccini | 200/314 |
| 4,343,975 | 8/1982 | Sado | 200/314 |
| 4,349,705 | 9/1982 | Kuhfus | 200/314 X |
| 4,493,958 | 1/1985 | Hamilton | 200/314 |

FOREIGN PATENT DOCUMENTS

| | | | |
|---|---|---|---|
| 2837209 | 3/1980 | Fed. Rep. of Germany | 200/314 |
| 2928146 | 1/1981 | Fed. Rep. of Germany | 200/314 |
| 2311396 | 5/1976 | France | 200/314 |

*Primary Examiner*—Stephen Marcus
*Assistant Examiner*—Ernest G. Cusick
*Attorney, Agent, or Firm*—A. G. Douvas

[57] ABSTRACT

An illuminated membrane switch assembly lighted by internal bulb units. A membrane switch sub-assembly is finger touch actuated by a small translucent plastic button with a graphic overlay on its forward surface and a light-diffusing textured rear surface. A clear plastic backplate is provided for the membrane switch sub-assembly, and in one embodiment light is transmitted to the button directly through a complex partly opaque conductor area in the membrane switch by a single bulb unit mounted in the rear of an enclosing housing that has a white interior surface, and in another embodiment light is transmitted to the button through the switch conductive area by a bulb mounted inside the transparent backplate.

11 Claims, 9 Drawing Figures

10
4
15

10
16
15
17
14
58
56
13
31
21
12
20
17
19
29
11
24
23
27
26

25
28

ILLUMINATED MEMBRANE SWITCH

RELATED APPLICATION

This application is a continuation in part of our U.S. patent application Ser. No. 536,637 filed Sept. 28, 1983, now U.S. Pat. No. 4,493,958, entitled Illuminated Membrane Switch, assigned to the assignee of the present invention.

BACKGROUND OF THE INVENTION

Membrane switches, sometimes referred to as "touch contact switches" have achieved phenomenal success over the last decade due to their simplicity, reliability and very low cost. Generally, these switches include upper and lower flexible plastic films separated by an intermediate spacer film. The outwardly facing surface of the upper film, or a separate graphics film, bears a matrix of alpha-numeric or functional symbols representing the underlying switch matrix. The lower side of one film has a plurality of partly opaque complex conductor areas, one for each switch aligned with one of the indicia on the symbol matrix and also aligned with cooperating conductive areas on the other film. There have in the past been attempts to back light (light from an internal source positioned behind the switch) membrane switches but they have required specially designed conductive areas on the film to match the shape of each indicium on the individual switches to avoid shadowing or have required the use of transparent conductors. The specially designed opaque conductive areas have not performed satisfactorily, nor have switches with transparent conductors.

Moreover, since in these specially designed switches the conductive areas (which are opaque) are configured to have the shape of the transparent portion of the indicia or graphics displayed to the operator each conductive area is different, making the switch assembly extremely costly and even with such a costly switch assembly, shadow lines produced by the conductive areas still appear.

The membrane switches that have found commercial acceptance usually include a plurality of silk screened, printed or electro-deposited parallel conductive bars on the facing surfaces of the membrane films. The parallel bars on one film are perpendicularly related to the parallel bars on the other film and the films are spaced by a third spacer film having an aperture surrounding the aligned conductive areas on the films. One of the conductive areas has spaced input and output conductors and the other film has "short bars" so that upon touch depression of the short bar film switch the conductive bars on that film engage, and connect the input and output conductive bars on the other film, causing switch actuation. In one specific membrane switch that has been found reliable, the input and output conductor bars are arranged in circular configuration and several manufacturers presently make this specific type of membrane switch sub-assembly, including Sierra Corporation of Sylmar, Calif., Transparent Devices, Inc. of Westlake, Calif., and W. H. Brady Company of Milwaukee, Wis.

Membrane switches of this general type have achieved a considerable degree of success in office and business equipment such as calculators, copying machines and cash registers, and in a variety of other applications in which there is a readily available source of artificial ambient light. However, the membrane switch technology has not as yet achieved any significant degree of success in applications where a constant source of ambient light is not available, such as in outdoor and vehicular applications because it has not been possible thus far to adequately internally illuminate the switch indicia due to the shodow lines caused by the opaque conductors on the membrane films that block light.

It is the primary object of the present invention to provide an improved illuminated membrane switch.

SUMMARY OF THE PRESENT INVENTION

In accordance with the present invention, an improved illuminated membrane switch assembly is provided that is illuminated from an interior light source without any complicated lighting techniques. Toward this end the present membrane switch includes first and second membrane films separated by an apertured spacer film with a plurality of aligned partly opaque conductive areas on each of the films defining a matrix of individual switches. These three films define a membrane switch sub-assembly that is mounted in an undercut on the forward surface of a clear transparent backplate. A grid plate having a plurality of rectangular apertures is mounted against the forward face of this switch sub-assembly and a plurality of switch actuating rectangular plastic buttons are mounted in the grid plate apertures for limited reciprocating movement and define the actuating elements for the aligned switches. A graphic overlay sheet is placed over the grid plate and the entire assembly is held together by a bezel that clamps the parts together against the forward face of a box-like metal case. The flexible graphic overlay has graphic indicia that may be alpha-numeric or functional symbols, one over each of the translucent buttons. The buttons are bonded to the rear surface of the graphic film and are movable a short distance upon finger contact with the selected graphic symbol to depress the short bars of the aligned film against the conductive area on the other film, closing the switch and providing an output signal.

An important aspect of the present invention is that light is transmitted to illuminate the graphics from the rear of the backplate forwardly through, and not around, the partly opaque conductive areas of the switches. Toward this end the rectangular buttons are either molded of a translucent white plastic or have a translucent white film or paint on their rear surfaces. Further, the entire rear surface of the buttons has a coarse textured finish which may be produced by mold cavity coarse particle blasting, peening or by certain etching techniques. This coarse textured surface diffuses light laterally entering the rear surface of the button. This texturing combined with the white translucent transmissive characteristic of the buttons deflects light passing around the discrete conductors of the conductive areas in the button over the areas that would otherwise appear as shadow lines.

In one embodiment of the present invention, the transparent backplate is relatively thin and flat and the case is quite deep with a white painted interior. One bulb unit is mounted centrally in the rear of the case. Because the bulb is positioned far rearwardly of the transparent backplate and because the casing interior is painted white, the entire backplate is fairly evenly flooded with light.

In another embodiment of the present invention where housing size must be kept to a minimum, the transparent backplate has light bulb receiving recesses in its opposite sides that direct light from the bulb laterally through the backplate. A wide, shallow V-shaped groove in the rear of the backplate defines deflecting surfaces for light transmitted laterally in the backplate that deflect light forwardly through conductive areas in the switch sub-assembly. The rear surface of the backplate in this embodiment is painted opaque white. This provides very even lighting and cuts down the depth of the entire switch assembly.

DETAILED DESCRIPTION OF THE PREFERRED EMBODIMENTS

Figures 1, 2:
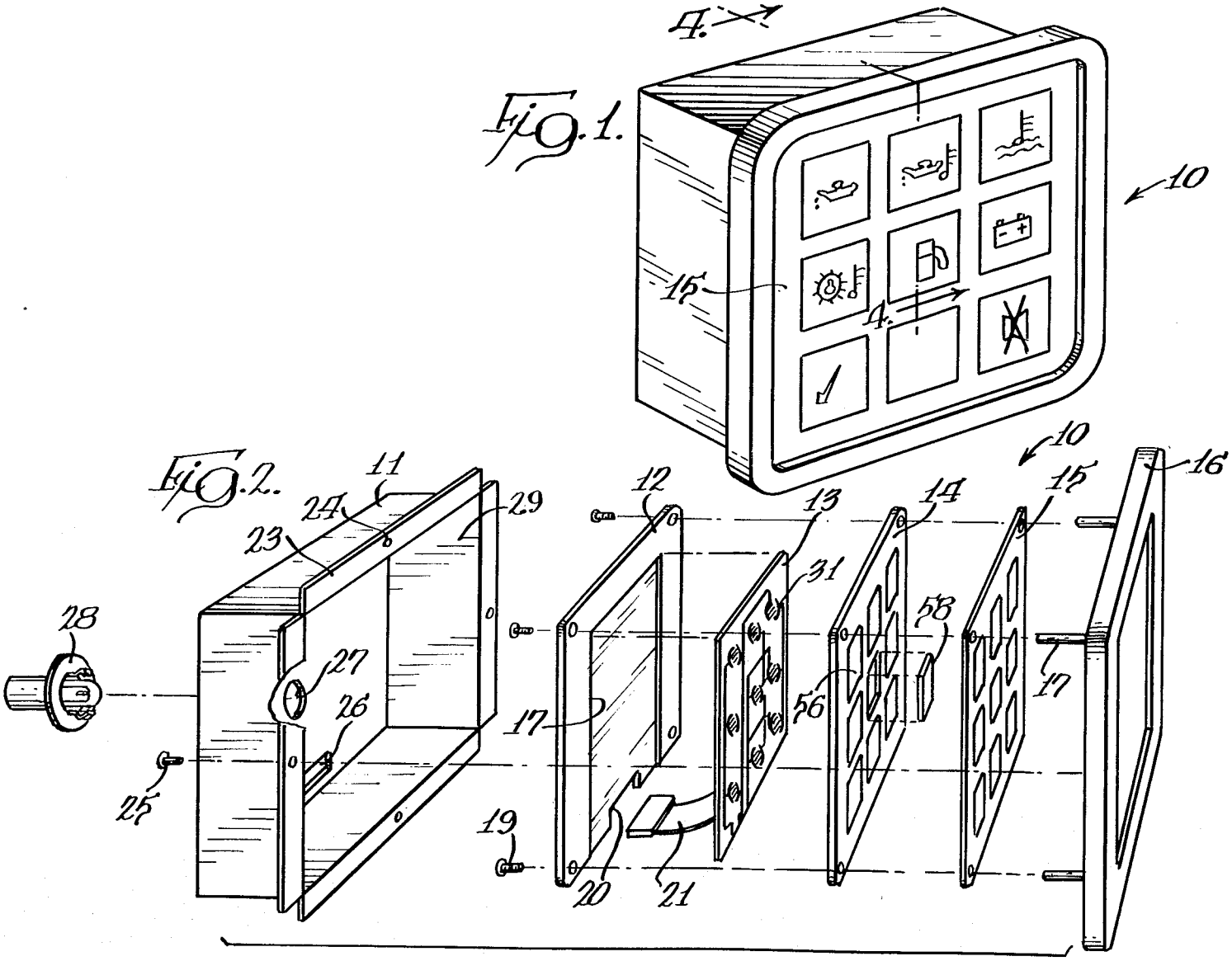
FIG. 1 is a perspective view of an illuminated membrane switch assembly according to one embodiment of the present invention.
FIG. 2 is an exploded perspective of the illuminated membrane switch assembly illustrated in FIG. 1.
Figure 3:
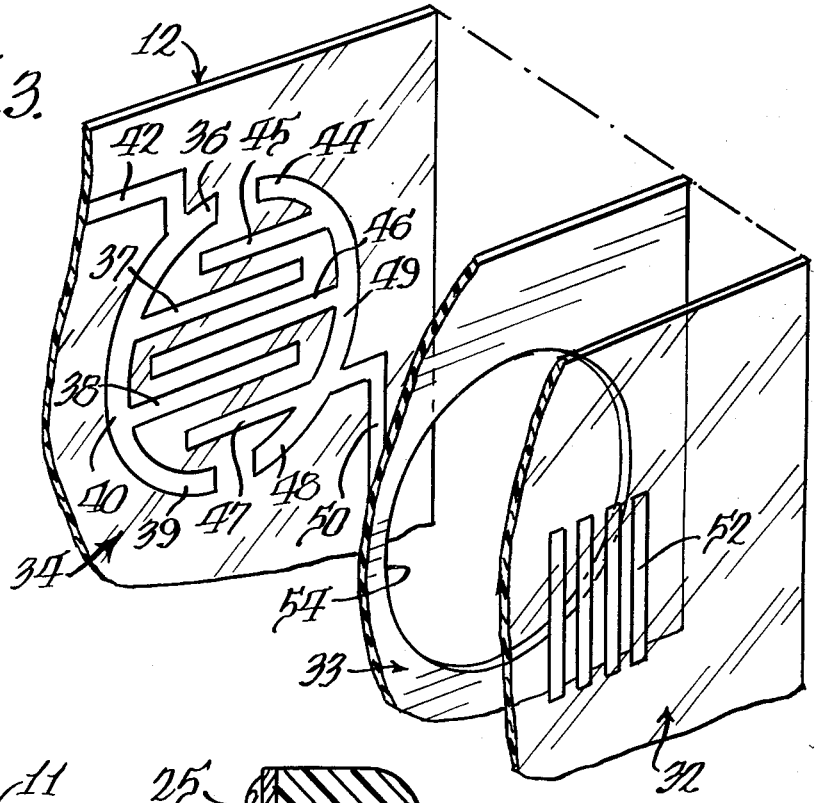
FIG. 3 is a fragmentary exploded perspective view of the conductive areas on an exemplary one of the switches illustrated in the illuminated switch of FIGS. 1 and 2.

Viewing the drawings, and particularly FIGS. 1 to 3, an illuminated membrane switch assembly 10 is illustrated generally including a box-shaped case or housing 11, a rectangular clear plastic backplate 12, a membrane switch sub-assembly 13, a rectangular grid plate 14, a graphic overlay sheet 15 and a rectangular bezel 16 having fastener receiving bosses 17 that project through aligned holes in overlay 15, grid plate 14 and backplate 12 to clamp these members together in sandwich fashion held in that position by fasteners 19 that threadedly engage the bosses 17. The membrane switch sub-assembly 13 fits in a rectangular recess 17 in the backplate 12 and the backplate is notched at 20 to receive a terminal strip 21 projecting from the switch 13.

Figure 4:
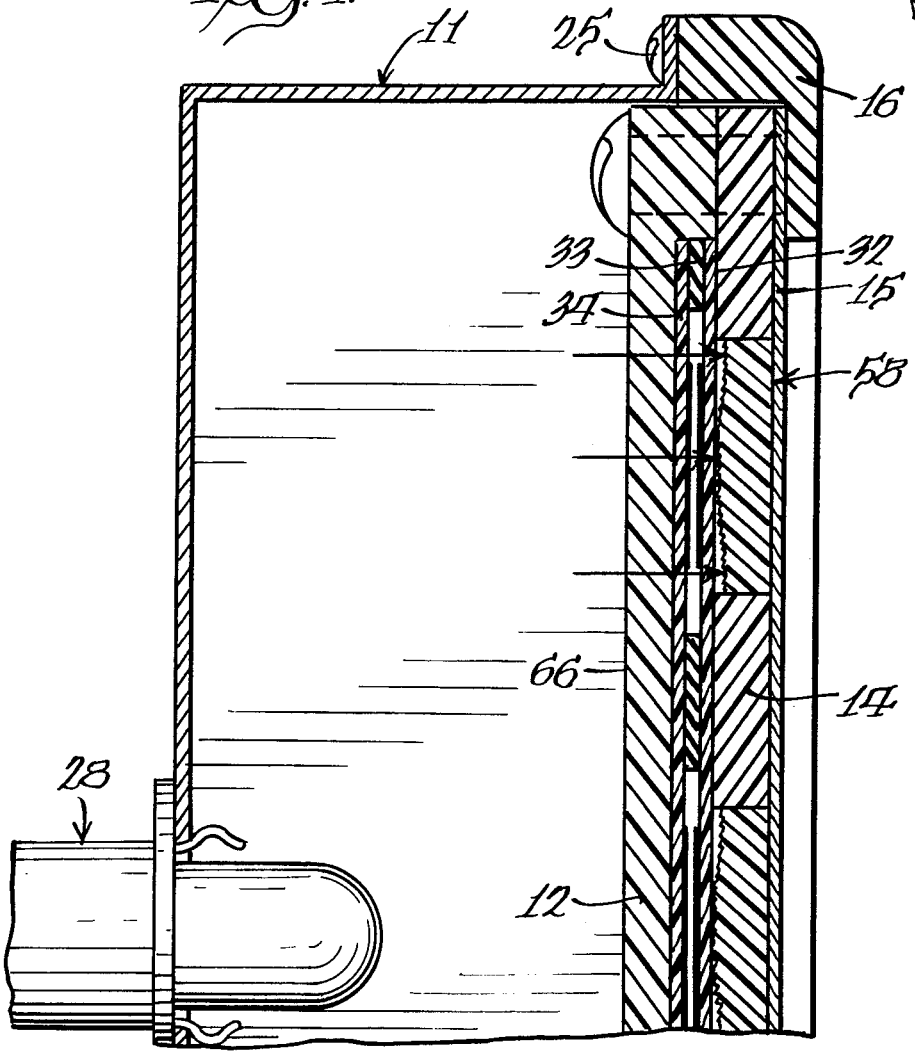
FIG. 4 is an enlarged fragmentary cross-section taken generally along line 4—4 of FIG. 1.
Figure 5:
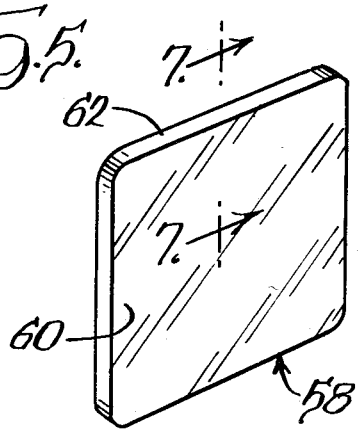
FIG. 5 is a perspective view of one of the actuator buttons illustrated in FIGS. 2 and 4.

The square case 11 is metal and has four peripheral flanges 23 with central apertures 24 that receive fasteners 25 that engage threaded holes (not shown) in the rear of the bezel 16 to hold the entire switch assembly together as a unit. The bottom wall of the case 11 has a central aperture 27 that receives a bulb unit 28. The entire interior 29 of the case 11 is painted white and the side walls are quite deep as shown in FIG. 4 so that bulb unit 28 evenly floods the rear surface of the back plate 12 with light.

The membrane switch sub-assembly 13 includes a matrix of nine switches 31, one of which is illustrated in FIG. 3 and is seen to include portions of a forward flexible membrane film 32, an apertured spacer membrane film 33, and a rear flexible membrane film 34. Conductors are deposited on the rear surface of the forward film 32 and the forward surface of the rear film 34. The conductors may be formed by a plurality of metallic deposition techniques such as electro-chemical deposition or sputtering. The conductors on the forward surface of the rear film 34 include parallel straight conductor fingers 36, 37, 38 and 39 connected together by common semi-circular conductor 40, all positively biased by an input conductor 42 fed from a positive DC source. The inner surface of the film 34 has a second set of conductor bars 44, 45, 46, 47 and 48 interconnected by a common semi-circular conductor 49 having an output conductor 50.

The rear surface of the forward film 32 has five straight parallel conductor bars 52 thereon, each having a length approximately equal to the diameter of the conductive area defined by the arcuate conductors 40 and 49 on film 34 and having a cumulative width slightly less than that diameter. The conductor bars 52 are sometimes referred to as "short bars" since when the switch is depressed engaging bars 52 with the conductive area on film 34, the conductors 36, 37, 38 and 39 are shorted to the conductors 44, 45, 46, 47 and 48 making the switch and causing an output at conductor 50.

The spacer 33 has a circular aperture 54 therein, one for each switch 31 illustrated in FIG. 2, and these apertures are somewhat greater in diameter than the conductive areas on the films 32 and 34 so that it normally spaces the film 32 from film 34 but permits engagement therebetween upon relatively small movement of the forward film 32 under finger pressure applied to graphic overlay 15. In this regard it should be understood that the film 32, 33 and 34 are thin transparent flexible plastic films. As noted in the above summary the membrane switch sub-assembly 13 is a conventional readily commercially available item.

There is an input conductor 42 and an output conductor 50 provided for each of the nine switches shown in the matrix, and these conductors extend through the terminal strip 21 and which projects through a slot 56 in the rear of case 11 where it is attachable to a suitable connector.

The grid plate 14 as seen in FIG. 2 has nine square apertures 56 arranged in rows of three each aligned with one of the switches 31 in the switch sub-assembly 13. The apertures 56 receive square actuating buttons 58 shown more clearly in FIGS. 4 to 7. The buttons 58 are only slightly smaller in dimension than the apertures 56 so that they are guided by and freely slidable with respect to the grid plate 14. The grid plate 14 is constructed of a rigid clear plastic such as a rigid polycarbonate.

The flexible graphic overlay 15 is a flexible polyester or polycarbonate sheet that is opaque except for the functional symbols illustrated in FIG. 1 and except for their rectangular borders, and these are translucent areas which pass light so that functional symbols and the borders are illuminated by light 28. Overlay 15 is bonded to the forward face of grid plate 14 and the forward surface of buttons 58.

Figure 6:
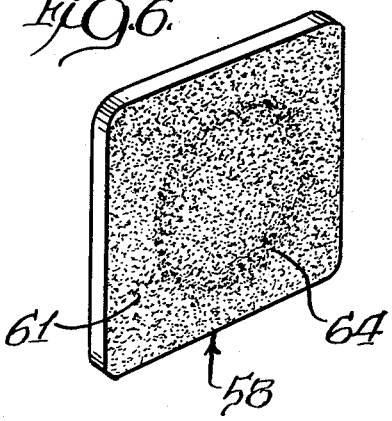
FIG. 6 is a rear perspective view of the actuator button illustrated in FIG. 5.
Figure 7:
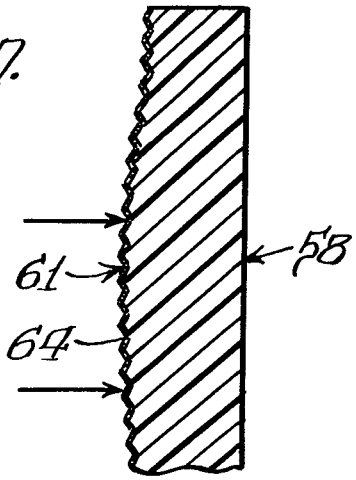
FIG. 7 is an enlarged fragmentary section of the button taken generally along line 7—7 of FIG. 5.

As seen in FIGS. 4, 5, 6 and 7 the actuator buttons 58 are square, each having a forward face 60 and a rear face 61 interconnected by equal length perpendicular side walls 62. The buttons 58 are preferably molded from a rigid white translucent plastic. The rear surface 61 of the buttons has a central spheroidal crown 64 that provides improved switch actuation because it centers the actuating force on the short bars 52. The entire rear surface 61 of the buttons is deeply textured as illustrated in FIGS. 6 and 7. This may be effected either by mold cavity heavy particle blasting, peening or by certain chemical etching techniques.

As an alternative to forming buttons 58 from a white translucent material, the rear surface 61 of the buttons may be painted with a translucent white paint and this modification has been found satisfactory for many applications.

As seen more clearly in the fragmentary assembly illustrated in FIG. 4, the actuator buttons 58 have a width greater than the diameter of the conductive areas on the front film 32 and the rear film 34 and a maximum thickness equal to the thickness of grid plate 14 so that the front film 32 is undeflected in the "off" position of the switches.

Because of the depth of the case 11 and its white interior, light substantially floods rear surface 66 of transparent backplate 12 and hence light passes axially through the backplate 66, films 34 and 32 into the rear surface of the buttons 58. Because of the width of the buttons 58 and the outer diameter or width of the conductive areas on the films 32 and 34, some of the light will enter the buttons 58 outside the periphery of the arcuate conductors 40 and 49, and the remainder will enter the buttons 58 between the conductors 36, 37, 38, 39, 44, 45, 46, 47, 48 and the short bars 52, all of which are opaque. Thus the pattern of light entering the rear surface of button 58 is determined by the blocking effect of the conductive areas; or expressed another way, the pattern of light falling on the rear surface of the buttons is defined by the combined masking effect of the conductive areas. However, most of the light impinging on the rear surface 61 of the buttons is diffused or deflected laterally within the translucent button by the surface texturing and this, combined with the translucent white material of the buttons, causes the entire button to be flooded evenly with light totally eliminating any shadowing that would otherwise be caused by the opaque conductive areas.

As an alternative to forming backplate 12 from a clear plastic material, it could be formed from a white translucent plastic material for more even light distribution.

Figure 8:
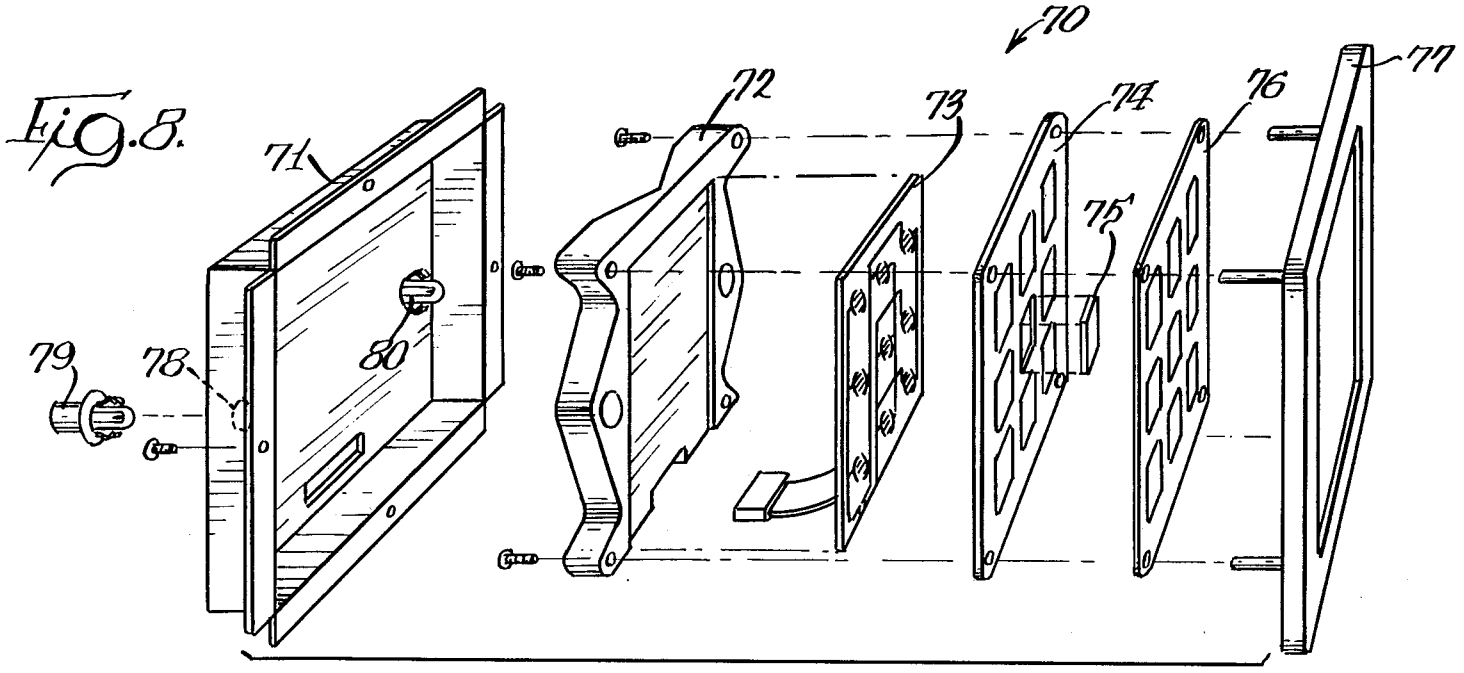
FIG. 8 is an exploded perspective of an illuminated switch assembly according to a second embodiment of the present invention.
Figure 9:
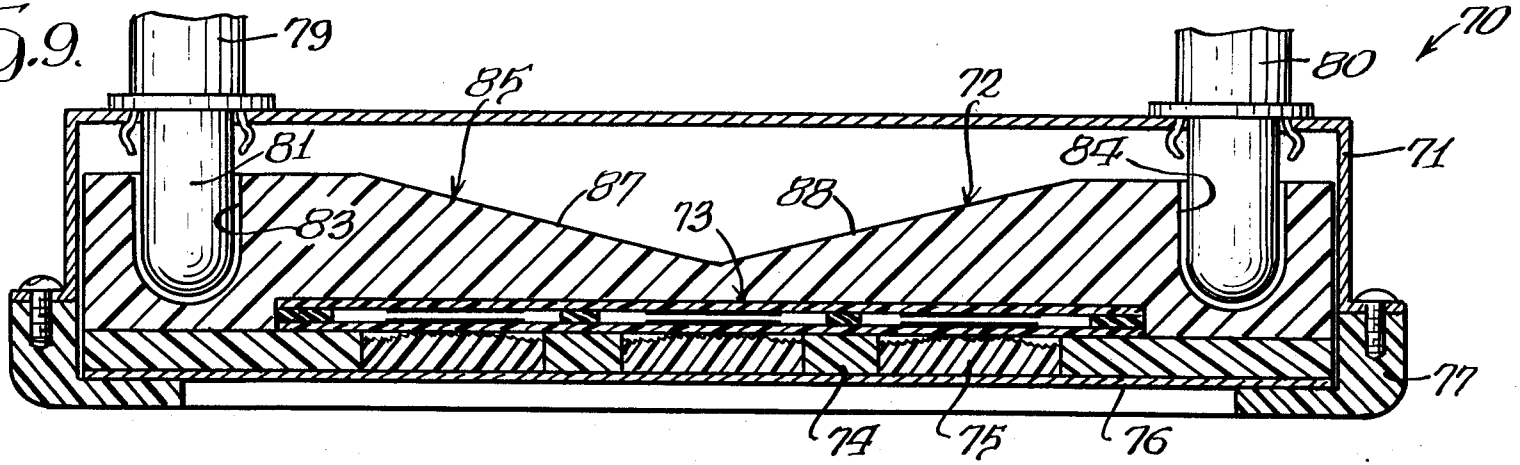
FIG. 9 is a cross-section of the illuminated switch assembly illustrated in FIG. 8.

Another embodiment of the present invention is illustrated in FIGS. 8 and 9 generally similar to the embodiment illustrated in FIGS. 1 to 4 except that illuminated membrane switch 70 is particularly adapted for shallow case applications. Switch assembly 70 is seen to generally include box-like square case 71, rigid transparent backplate 72, switch sub-assembly 73, square grid plate 74 slidably receiving actuator buttons 75, graphic overlay 76 and bezel 77.

With the exception of the case 71 and backplate 72, the switch assembly 70 is identical to the switch assembly 10 illustrated in FIGS. 1 to 4 so that the common parts and manner of operation are the same.

The case 71 is metal and significantly shallower than the case 11 in the FIGS. 1 to 4 embodiment and includes widely spaced apertures 78 in its rear wall that receive bulb assemblies 79 and 80. Bulb assemblies 79 and 80 have elongated bulbs 81 that project within complementary recesses 83 and 84 in the rear surface of the backing plate 72. The backing plate 72 is constructed of a rigid transparent plastic or alternatively a translucent white plastic for more even light distribution, and acts as an optical conductor receiving light from bulbs 81 and transmitting it laterally throughout the body of the backplate. Rear surface 85 of the backplate is painted with opaque white paint and has a wide, shallow V-groove extending across its width defined by surfaces 87 and 88, which together have a width in the plane of FIG. 9 approximating the width of the switch sub-assembly 73. Surfaces 87 and 88 deflect light traveling laterally in the backplate 72 forwardly through the switch assembly 73 and provides very even distribution of light across the entire switch sub-assembly.

We claim:

1. An illuminated membrane switch assembly, comprising; a first flexible film member having a partly opaque conductive area on one side thereof, a second flexible film member adjacent and normally spaced from the one side of the first film member, said second film member having a partly opaque conductive area aligned with the first conductive area and being on the side of said second film member adjacent said first film member, said second conductive area including spaced switch contacts positioned to be electrically closed when simultaneously contacted by the conductive area on the first film member when one of the film members is pressed into engagement with the other film member, at least one of said conductive areas having opaque portions extending substantially centrally across the conductive area, a movable switch actuator member mounted adjacent one of the first and second film members having indicia thereon adapted to be illuminated, said actuator member having an axis substantially perpendicular to said film members and a translucent light diffusing surface substantially parallel and aligned with the conductive areas on the first and second film members, a transparent backplate behind and supporting the first and second film member, and a source of light positioned behind the first and second film members to direct light through the backplate substantially parallel to and substantially along said axis, through the first and second film members conductive areas and into the actuator member to be diffused therein by the light diffusing surface to eliminate shadowing caused by the conductive area.

2. An illuminated membrane switch assembly, comprising; a first flexible film member having a partly opaque conductive area on one side thereof, a second flexible film member adjacent and normally spaced from the one side of the first film member, said second film having a partly opaque conductive area aligned with the first conductive area and being on the side of said second film member adjacent said first film member, said second conductive area including spaced switch contacts positioned to be electrically closed when simultaneously contracted by the conductive area on the first film member when one of the film members is pressed into engagement with the other film member, at least one of said conductive areas having opaque portions extending substantially centrally across the conductive area, a translucent movable switch actuator member having an axis substantially perpendicular to said film members and mounted in axial alignment with the first and second conductive areas and adjacent one of the first and second film members having indicia thereon on the side thereof opposite the first and second film members, a light source positioned behind the first and second film members for projecting light through the partly opaque conductive areas substantially parallel to and substantially along the axis of the actuator member, said translucent member having a translucent irregular surface area on its rear surface substantially parallel to the film members for diffusing light entering the rear of the actuator member from the source of light so that light passing directly through the partly opaque areas of the first and second film members substantially parallel to and along said axis is diffused by the rear surface of the actuator member to eliminate shadowing caused by the conductive areas.

3. An illuminated membrane switch assembly, as defined in claim 1, including a stationary grid having an opening therein adjacent the conductive areas, said actuator member including a button slidable in said opening, said indicia being defined by a flexible graphics overlay attached over the grid opening and connected to the button.

4. An illuminated membrane switch assembly, as defined in claim 3, wherein the button has a width greater than the width of the conductive areas on the first and second film members, said light source being positioned on the side of the backplate opposite the first and second film members, said housing having a white interior to deflect light from the source through the backplate.

5. An illuminated membrane switch assemblly as defined in claim 3, including at least one aperture in the backplate, said light source being mounted in the aperture in the backplate so that light is diverted laterally through the backplate, and means on the backplate for directing light forwardly through the conductive areas on the first and second film members.

6. An illuminated membrane switch assembly, comprising; a first flexible film member having a partly opaque conductive area on one side thereof, a second flexible film member having a partly opaque conductive area in axial alignment with the first conductive area, adjacent and normally spaced from the one side of the first film member and including spaced switch contacts positioned to be electrically closed when simultaneously contacted by the conductive area on the first film member when one of the film members is pressed into engagement with the other film member, at least one of said conductive areas having opaque portions extending substantially centrally across the conductive area, housing means for the first and second film members including a front grid plate having an aperture therein aligned with the conductive areas on the first and second film members, a switch actuator member having an axis substantially perpendicular to the film members and positioned in the aperture having indicia thereon adapted to be illuminated, said actuator member having a rear translucent light diffusing surface substantially parallel to the film members and axially aligned with the conductive areas on the first and second film members, a transparent backplate behind and supporting the first and second film members, and a source of light positioned well behind the backplate for directing light substantially parallel to and substantially along the axis of the actuator member through the backplate, the conductive areas into the rear of the actuator member, said housing including a deep case in which the light source is mounted and having a white interior to direct light from the source through the backplate and through the conductive areas and through the rear surface of the actuator member to be diffused by the light diffusing surface to eliminate shadowing caused by the conductive areas.

7. An illuminated membrane switch assembly, as defined in claim 6, wherein the switch actuator member is constructed of white translucent plastic and is reciprocable in the front plate aperture, the rear surface of the actuator member being white translucent and coarsely textured to diffuse light passing axially into the rear surface of the actuator member from the conductive areas.

8. An illuminated membrane switch assembly, as defined in claim 6, wherein the light source is positioned centrally in the rear of the casing.

9. An illuminated membrane switch assembly, comprising; a first flexible film member having a partly opaque conductive area on one side thereof, a second flexible film member in axial alignment with the first conductive area and adjacent and normally spaced from the one side of the first film member, said second film member having a partly opaque conductive area on the side thereof adjacent the first film member and including spaced switch contacts positioned to be electrically closed when simultaneously contacted by the conductive area on the first film member when one of the film members is pressed into engagement with the other film member, at least one of said conductive areas having opaque portions extending substantially centrally across the conductive area, housing means for the first and second film members including a front plate having an aperture therein aligned with the conductive areas on the first and second film members, a switch actuator member having an axis substantially perpendicular to the film members and positioned in the aperture having indicia thereon adapted to be illuminated, and a source of light positioned to direct light directly axially substantially parallel to and substantially along the axis of the actuator member through the conductive areas on the first and second film members into the rear surface of the actuator member, said indicia being formed on a flexible graphic overlay attached to the housing front plate and extending over the aperture therein, said switch actuator including a white translucent button fixed to the graphic overlay and reciprocable in the front plate aperture, said button having a substantial textured rear surface area substantially parallel to and in alignment with the conductive areas on the first and second film members, said button being movable to a position causing engagement between the conductive areas on the first and second film members, said button textured rear surface being positioned to receive light passing directly through the conductive areas on the first and second film members and to laterally diffuse the light in the button to eliminate shadowing caused by the conductive areas.

10. An illuminated membrane switch assembly, comprising; a first flexible film member having a partly opaque conductive area on one side thereof, a second flexible film member adjacent and normally spaced from the one side of the first film member, said second film member having a partly opaque conductive area in axial alignment with the first conductive area on the side thereof adjacent the first film member and including spaced switch contacts positioned to be electrically closed when simultaneously contacted by the conductive area on the first film member when one of the film members is pressed into engagement with the other film member, at least one of said conductive areas having opaque portions extending substantially centrally across the conductive area, housing means for the first and second film members including a front plate having an aperture therein aligned with the conductive areas on the first and second film members, a switch actuator member having an axis substantially perpendicular to said film members and positioned in the aperture having indicia thereon adapted to be illuminated, a source of light positioned to direct light directly axially substantially parallel to and substantially along the axis of the actuator member through the conductive areas on the first and second film members into the rear surface of the actuator member, said indicia being formed on a flexible graphic overlay attached to the housing front plate and extending over the aperture therein, said switch actuator including a white translucent button fixed to the graphic overlay and reciprocable in the front plate aperture, said button having a textured rear surface area substantially parallel to the film members and in alignment with the conductive areas on the first and second film members, said button being movable to a position causing engagement between the conductive areas on the first and second film members, said button textured rear surface being positioned to receive light passing directly through the conductive areas on the first and second film members and to laterally diffuse the light in the button to eliminate shadowing caused by the conductive areas, a transparent backplate behind the first and second film members, at least one recess in the rear of the backplate, said light source including a light bulb in the backplate recess so that light is directed laterally in the backplate, and an oblique surface on the rear of the backplate to deflect light passing laterally in the backplate forwardly through the conductive areas on the first and second film members.

11. An illuminated membrane switch assembly as defined in claim 10, wherein there are provided a plurality of buttons, each aligned with one of a plurality of conductive areas on the first and second film members to define a plurality of switches in the housing means, there being provided two recesses in the rear of the backplate for receiving two light bulbs, said oblique surface being one of two intersecting surfaces together forming a "V" shape in the rear of the backplate between the bulb receiving recesses.

* * * * *